US008833687B2

(12) United States Patent
Harbold et al.

(10) Patent No.: US 8,833,687 B2
(45) Date of Patent: Sep. 16, 2014

(54) CRUSHING ROLL WITH EDGE PROTECTION

(75) Inventors: Keith Harbold, York, PA (US); Vadim Reznitchenko, Mechanicsburg, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 147 days.

(21) Appl. No.: 13/451,875

(22) Filed: Apr. 20, 2012

(65) Prior Publication Data

US 2013/0277481 A1 Oct. 24, 2013

(51) Int. Cl.
*B02C 4/30* (2006.01)

(52) U.S. Cl.
USPC ..... 241/293; 241/226; 241/235; 241/300

(58) Field of Classification Search
USPC ..... 241/226, 235, 293, 300
See application file for complete search history.

(56) References Cited

U.S. PATENT DOCUMENTS

| | | | | |
|---|---|---|---|---|
| 5,000,392 | A * | 3/1991 | Kästingschäfer et al. | 241/294 |
| 5,054,701 | A * | 10/1991 | Durinck et al. | 241/167 |
| 5,253,816 | A * | 10/1993 | Kastingschafer et al. | 241/227 |
| 5,269,477 | A * | 12/1993 | Buchholtz et al. | 241/293 |
| 7,497,396 | B2 * | 3/2009 | Splinter et al. | 241/294 |
| 7,510,135 | B2 | 3/2009 | Burchardt et al. | |
| 2010/0058570 | A1 * | 3/2010 | Patzelt et al. | 29/402.06 |
| 2011/0011965 | A1 * | 1/2011 | Mirchandani et al. | 241/277 |

FOREIGN PATENT DOCUMENTS

| | | | | |
|---|---|---|---|---|
| AU | WO2012031324 | A1 * | 7/2011 | B02C 4/30 |
| GB | 996768 | A | 6/1965 | |
| WO | 2012/031324 | A1 | 3/2012 | |

OTHER PUBLICATIONS

PCT International Search Report and Written Opinion dated Jun. 18, 2013.

* cited by examiner

*Primary Examiner* — Faye Francis
*Assistant Examiner* — Onekki Jolly
(74) *Attorney, Agent, or Firm* — Andrus Intellectual Property Law, LLP

(57) ABSTRACT

A grinding assembly for the comminution of material that enhances the durability of the side edges of both a grinding roll and a flange roll. Both the grinding roll and the flange roll include a wear ring that is received within a side groove formed at each end of a cylindrical roll body. The wear ring includes a series of spaced receiving cavities that each receive a wear member. Each wear member includes a radially outer surface and an axial end face to enhance the durability of the edge of the roll body. The edge ring is retained on the roll body by a series of connectors that pass through the edge ring. In the flange roll design, a flange ring is attached to the roll body by a series of connectors that also secure the edge ring to the roll body.

20 Claims, 9 Drawing Sheets

CRUSHING ROLL WITH EDGE PROTECTION

BACKGROUND

The present disclosure generally relates to a grinding assembly including a pair of grinding rolls for the pressure comminution of materials. More specifically, the present disclosure relates to a grinding assembly including a grinding roll and a flange roll that each include a wear assembly that enhances the durability of the roll at the side edge of each of the grinding rolls.

Presently, rolling mills grind material by drawing the material into a roller nip formed by two counter-rotating grinding rolls that are separated from each other and subject to a pressurized force. The material being ground passes between the nip formed between the pair of grinding rolls. The surfaces of each of the grinding rolls are thus subject to a high level of wear.

It is known to make the outer surface of each of the grinding rolls more wear resistant by including a series of prefabricated hard metal bodies, such as studs, that extend from the cylindrical outer surface of the grinding roll. The stud bolts typically protrude from the outer surface of the roll body such that during the crushing action, a bed of material forms along the outer surface of the roll body between the studs to provide additional wear resistance for the roll body.

In addition to the outer surface of the grinding roll, the end faces and the transitional edge between the outer surface and the end faces of the roll bodies are also subjected to a high level of wear during the continued pressure comminution of material. It is known to provide different types of reinforced edges on the roller body to reduce the amount of wear seen by the grinding roll. As an example, U.S. Pat. Nos. 7,497,396 and 7,510,135 disclose different types of edge protectors that increase the durability of the edge of a grinding roll. Although these two references disclose different types of edge protection, limitations exist in each of the systems disclosed therein.

SUMMARY

The present disclosure relates to a grinding assembly for the comminution of material. The grinding assembly includes a grinding roll and a flange roll that are positioned adjacent to each other to define an infeed nip that receives material for comminution. The grinding roll and the flange roll are biased into engagement with each other.

The grinding roll and the flange roll both include a roll body that has a cylindrical outer surface that extends axially between a pair of opposite ends. The cylindrical outer surface of the roll body is configured to receive a series of studs that enhance the wear and durability of the cylindrical outer surface.

The roll body includes a side groove that is formed at each end of the roll body. The side groove includes a support shoulder that extends axially inward from a side face of the roll body. The support shoulder is recessed from the outer surface of the roll body.

An edge ring is received within each side groove and forms part of a wear assembly. The edge ring includes a series of receiving cavities that are spaced along the outer circumference of the edge ring. In one embodiment of the disclosure, the edge ring is formed from a plurality of individual edge ring sections that are joined in an end-to-end or interlocking configuration. Alternatively, the edge ring could be formed from a single, unitary component. The edge ring includes a series of connector openings that each receive a connector to attach the edge ring to the roll body. Preferably, the connectors are removable and replaceable to attach the edge ring to the roll body.

The plurality of wear members received by the edge ring are each configured to create a wear resistant edge defined as the transition between the side face and cylindrical outer surface of the roll body. Each wear member includes an attachment portion that is received within one of the plurality of spaced receiving cavities formed on the edge ring. Preferably, the wear members are securely received within the receiving cavities and are positioned in an end-to-end or interlocking configuration to define each edge of the roll body.

The grinding assembly further includes a flange roll that includes the same components as the grinding roll. However, the flange roll further includes a flange ring that is positioned axially adjacent to the end ring. The flange ring extends axially outward from the end ring and includes an outer surface that is spaced radially from the outer surface of the roll body. In a contemplated embodiment, the flange ring is formed from a plurality of flange ring sections that are positioned adjacent to each other in an end to end or interlocking configuration. The flange ring sections are each secured to the roll body by a common series of connectors that also extend through the edge ring such that the common connectors secure both the edge ring and the flange ring to the roll body.

When the grinding roll and the flange roll are positioned adjacent to each other, the flange ring formed on the flange roll is positioned axially outward from the edge ring of the grinding roll. The interaction between the grinding roll and the flange roll creates the infeed nip while the flange aids in maintaining a high pressure crushing chamber on the side of the roll including the flange. In one contemplated embodiment, one or more shims are positioned between the edge ring and the flange ring during the construction of the flange roll. The shims provide the required spacing between the flange ring and the edge ring such that common components can be utilized to form both the grinding roll and the flange roll. Alternatively, each of the flange sections could include a ledge to create the required spacing.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
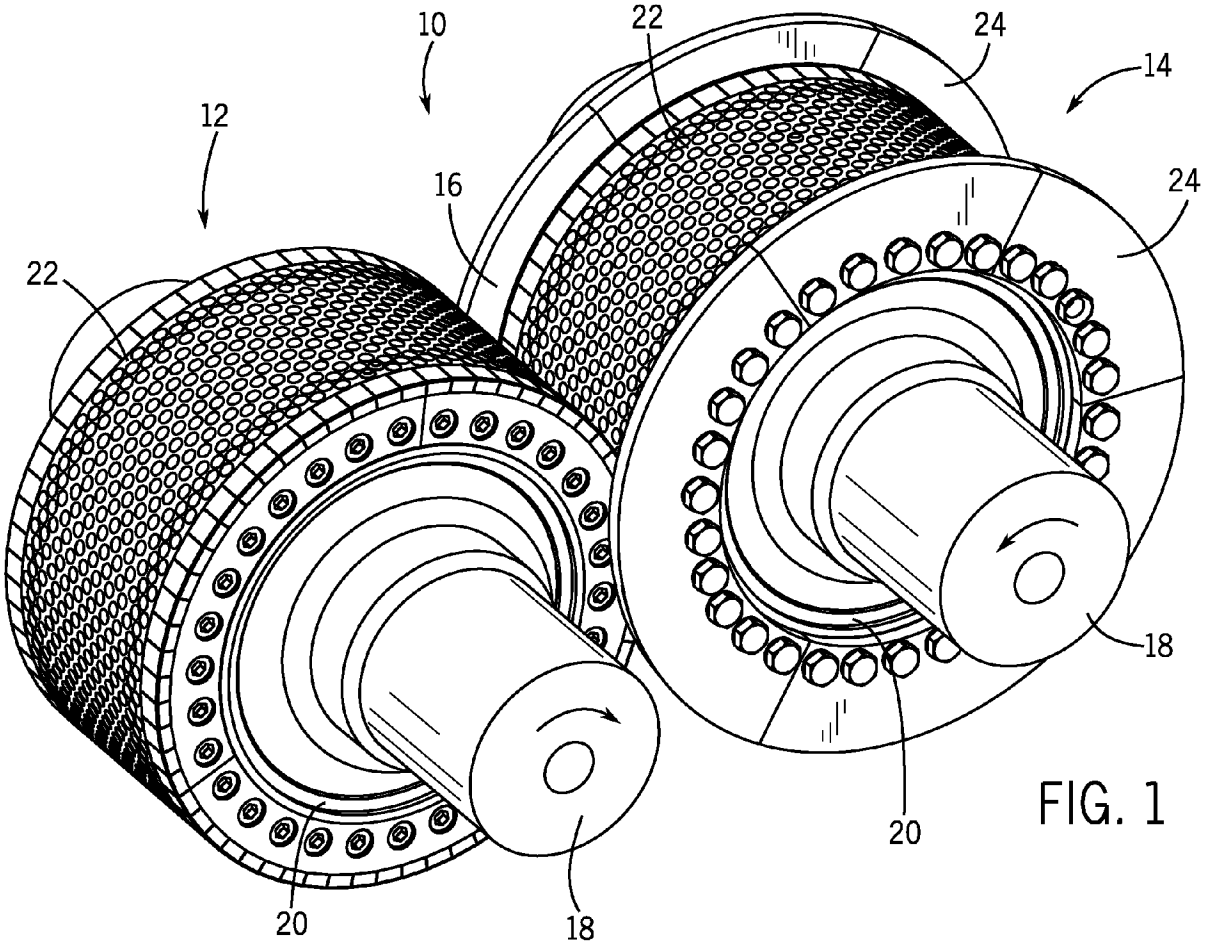
FIG. 1 is an isometric view of a grinding assembly including a grinding roll and a flange roll constructed in accordance with the present disclosure.

FIG. 1 illustrates a grinding assembly 10 for the pressure comminution of material. The grinding assembly 10 shown in FIG. 1 includes a pair of grinding rolls, referred to as grinding roll 12 and flange roll 14 that are positioned adjacent to each other to define an infeed nip 16. During operation, the grinding roll 12 and flange roll 14 rotate toward each other (see arrows) such that material is drawn into the infeed nip 16. The grinding roll 12 and the flange roll 14 are each respectively rotatable about a support shaft 18. A mechanical source of pressure (not shown) bias the grinding roll 12 and the flange roll 14 toward each other such that the source of pressure crushes the material passing through the infeed nip 16.

Both the grinding roll 12 and the flange roll 14 include a generally cylindrical roll body 20 that is defined by a cylindrical outer surface 22. The cylindrical roll body extends along and is rotatable about a longitudinal axis that passes through the center of the support shaft 18. In accordance with the present disclosure, both the grinding roll 12 and the flange roll 14 include many common components and are similar in many respects. In the following description, common components are referred to by common reference numerals to facilitate ease of understanding. The flange roll 14 is generally illustrated in FIGS. 2-5 while the grinding roll 12 is illustrated in FIGS. 6-9. In the description that follows for each of the rolls, reference may be made to the drawing Figures of the other type of roll. Since the grinding roll 12 and flange roll 14 share many components, the use of drawings showing one roll to describe the other roll is possible.

As illustrated in FIG. 1, the flange roll 14 includes a pair of flange rings 24 that are positioned axially outward of the cylindrical roll body 22 of the grinding roll 12 when the grinding roll 12 and the flange roll 14 are positioned to create the infeed nip 16. Although a flange roll 14 is shown in the embodiment of the grinding assembly 10 of FIG. 1, it should be understood that the flange roll 14 could be replaced by another grinding roll 12 in configurations in which the flange rings 24 are not required. As described, the flange roll 14 and the grinding roll 12 include many common components and the details of the construction for both the grinding roll 12 and the flange roll 14 will be described in much greater detail below.

Figure 2:
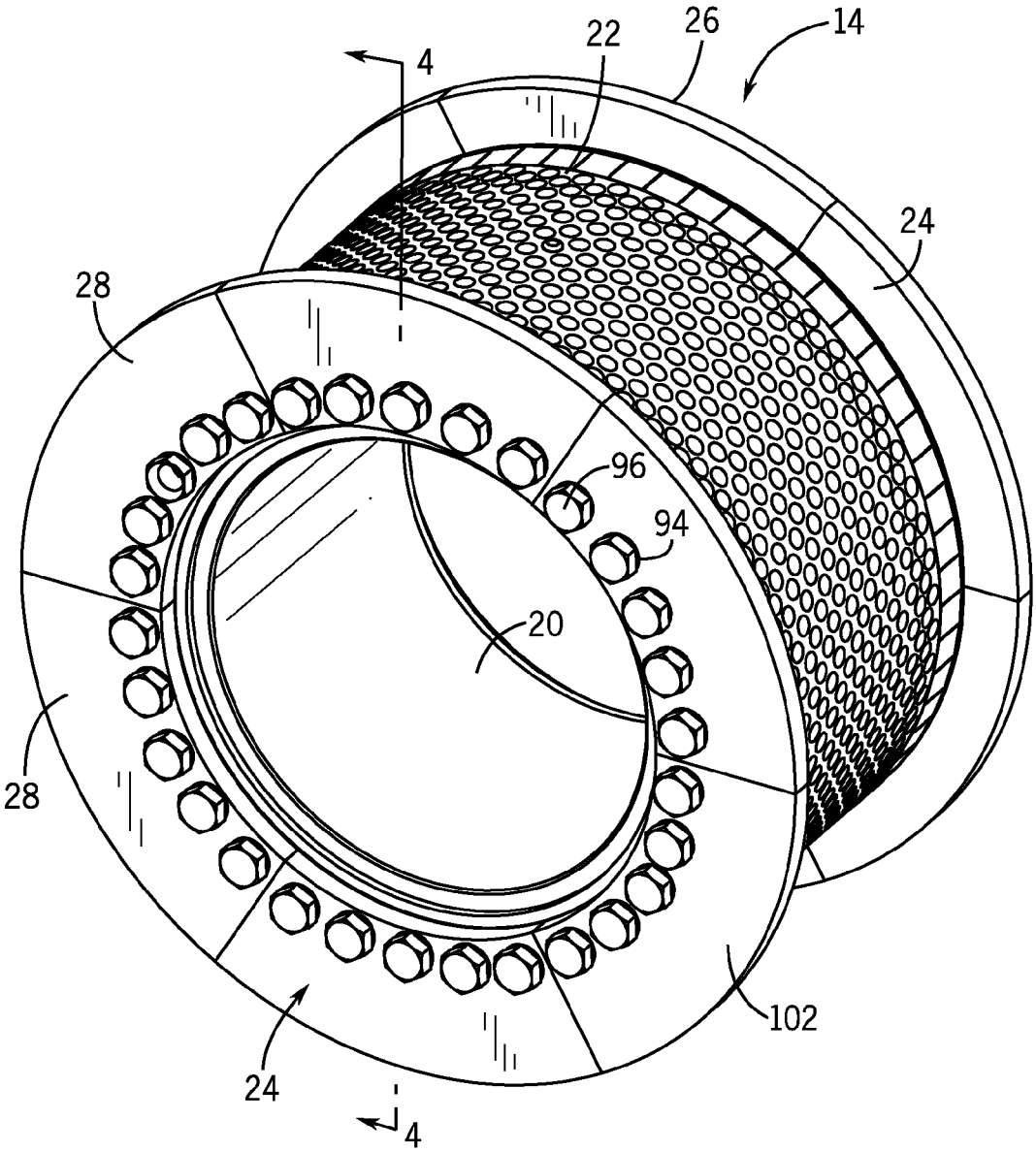
FIG. 2 is an isometric view of the flange roll.

FIGS. 2-5 illustrate the construction of the flange roll 14. As indicated above, the flange roll 14 includes a pair of flange rings 24 positioned on opposite axial ends of the flange roll 14. As illustrated in FIG. 2, the flange ring 24 defines a circular outer edge surface 26 that is spaced radially from the outer surface 22 of the roll body 20. In the embodiment shown in FIG. 2, the flange ring 24 is formed from six separate flange ring sections 28 that are positioned adjacent to each other in an end-to-end configuration to define the flange ring 24. Alternatively, the flange ring sections 28 could interlock with each other. Although six separate flange ring sections 28 are shown in the embodiment of FIG. 2, it should be understood that the flange ring 24 could be composed of fewer or greater numbers of flange ring sections 28 while operating within the scope of the present disclosure. Additionally, the flange ring 24 could be created as a single, unitary structure. The use of multiple flange ring sections 28 aids in both the construction of the flange roll 14 and the manufacturability of the flange ring sections 28.

Figure 3:
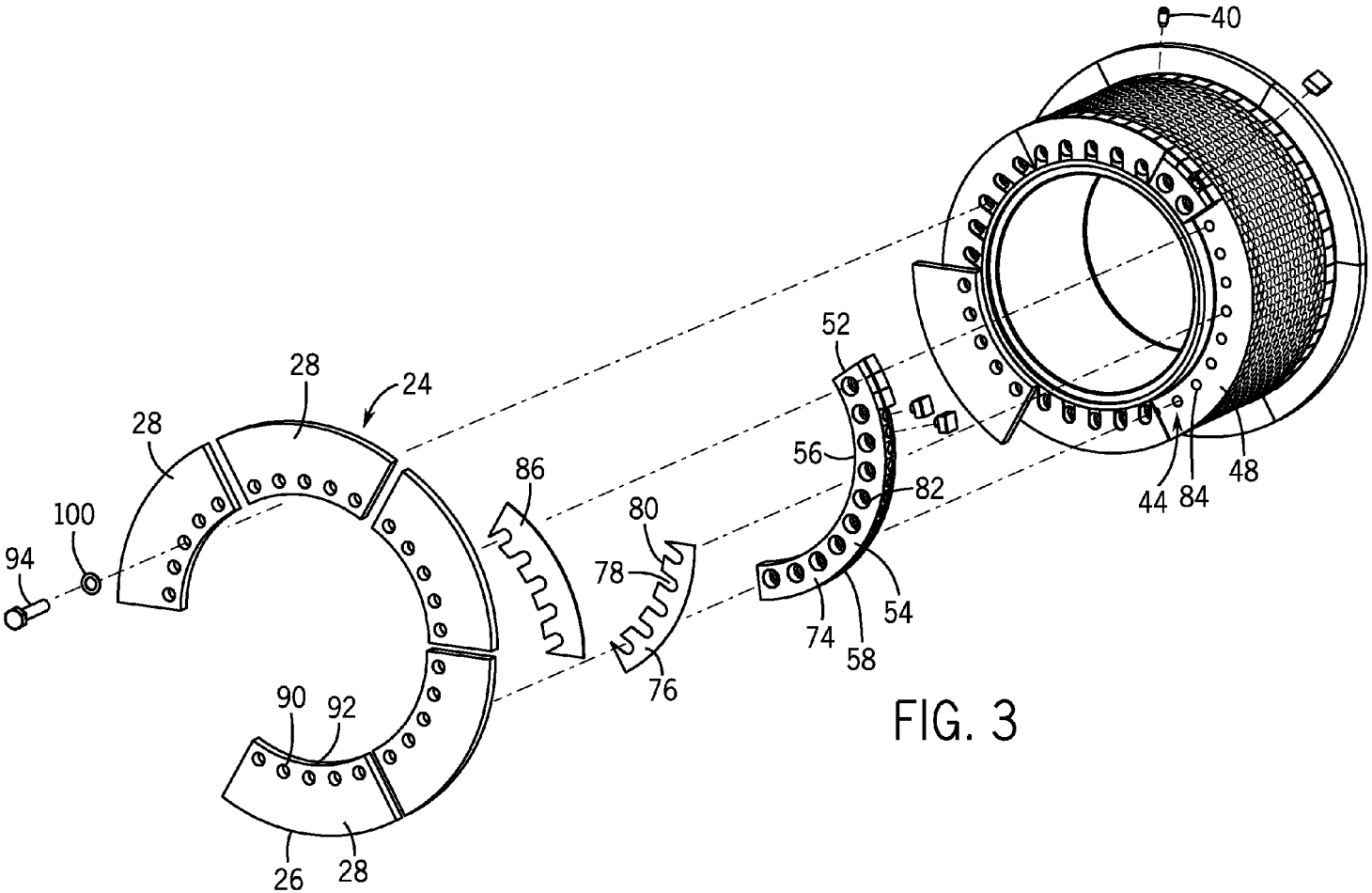
FIG. 3 is an exploded isometric view of the flange roll.
Figure 4:
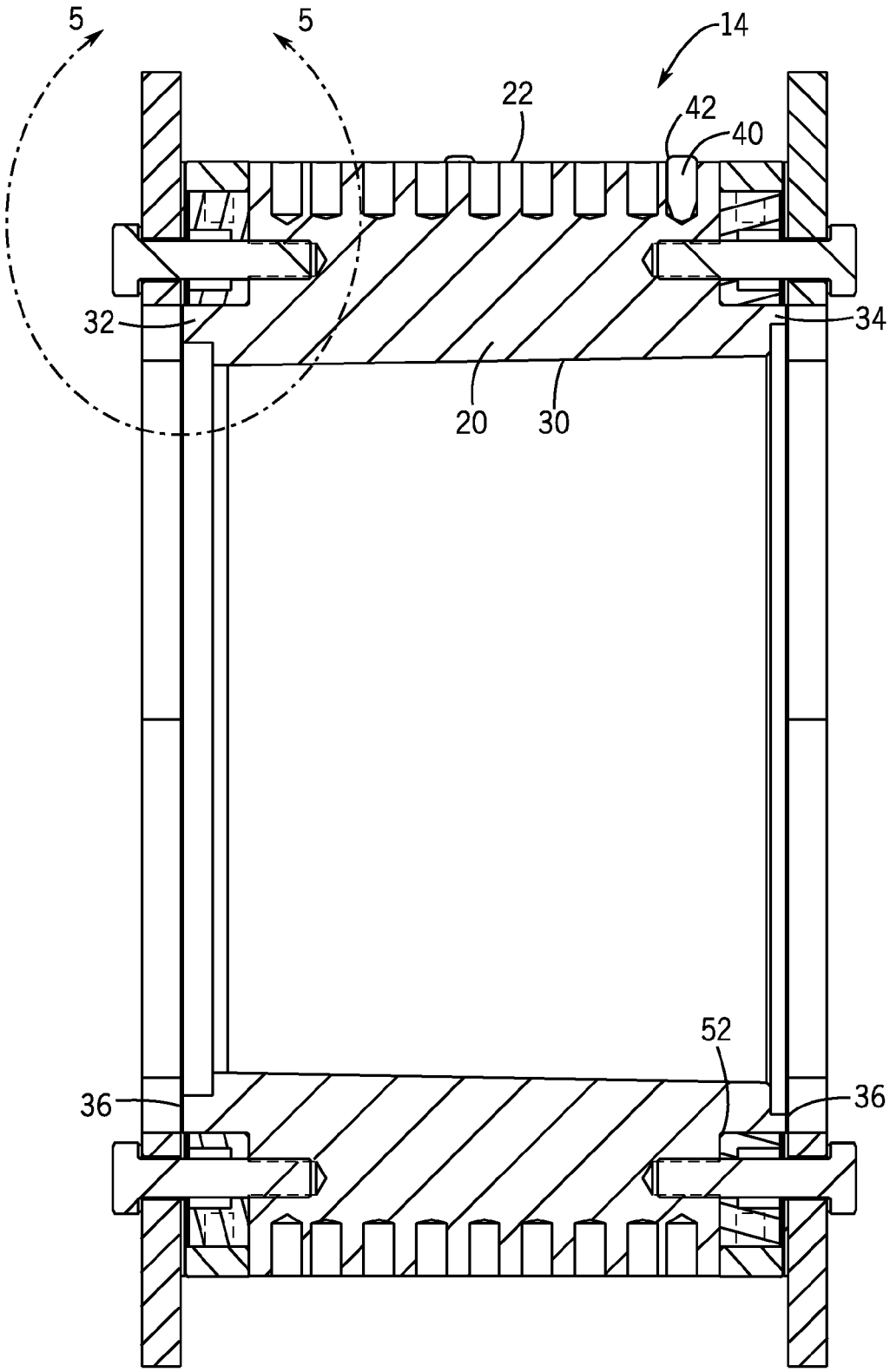
FIG. 4 is a section view taken along line 4-4 of FIG. 2.

Referring now to FIGS. 3 and 4, the flange roll 14 includes the cylindrical roll body 20 defined by an inner surface 30 and the outer surface 22. Preferably, the roll body 20 is formed from a durable, metallic material. The inner surface 30 receives and engages the support shaft that imparts rotation to the flange roll 14.

The roll body 20 extends axially from a first end 32 to a second end 34. The first and second ends 32, 34 of the flange roll 14 are defined by opposite side faces 36. Since the roll body 20 is annular, both of the side faces 36 are also annular.

Figure 5:
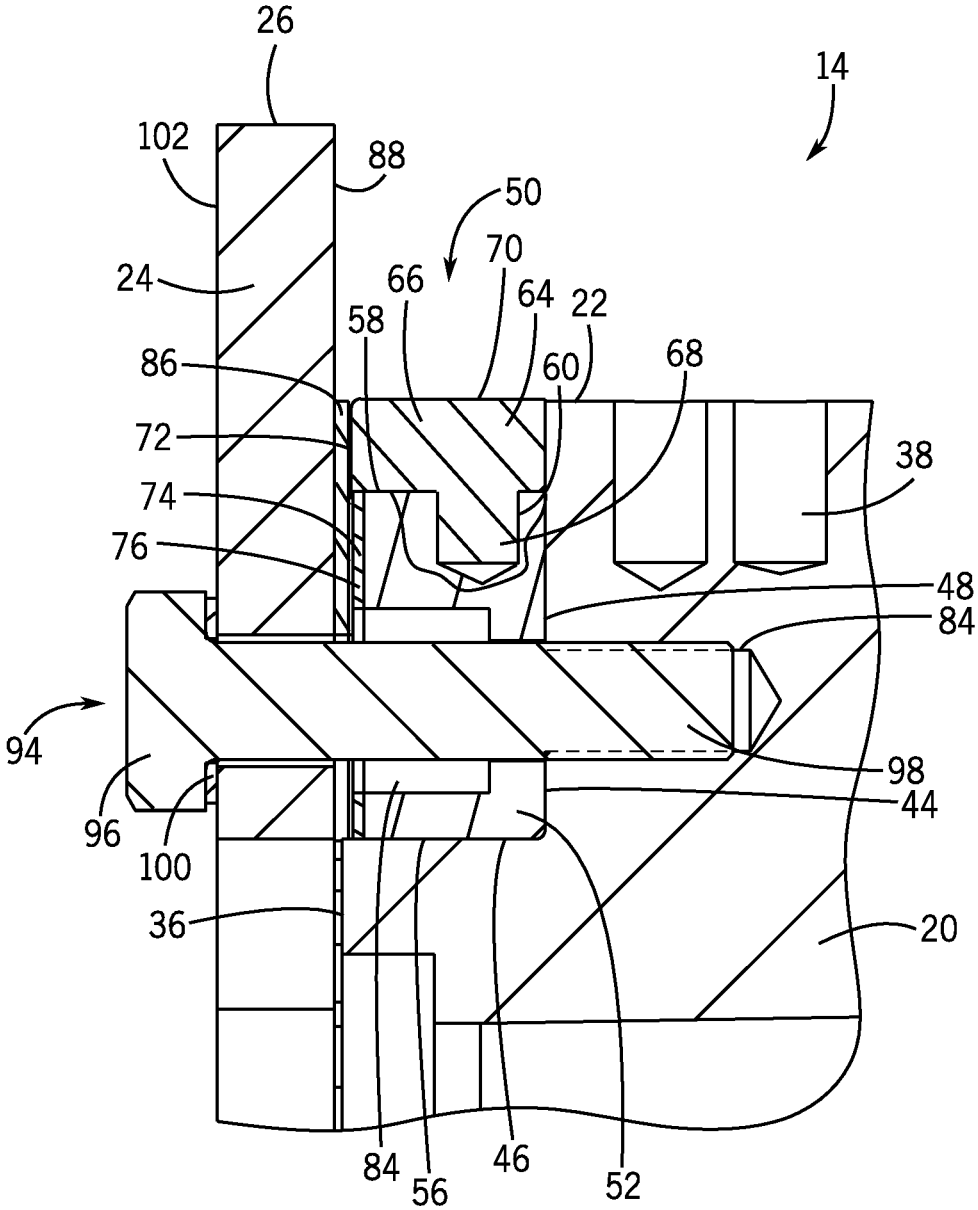
FIG. 5 is a magnified view taken alone line 5-5 of FIG. 4.

As best illustrated in FIGS. 4 and 5, the roll body 20 includes a series of receiving bores 38 that extend radially into the roll body 20 from the outer surface 22. Each of the receiving bores 38 receives a stud 40, as can best be seen in FIG. 7. Each of the studs 40 is formed from material that is more durable than the roll body. The studs 40 can be replaced when worn to extend the life of the grinding roll and flange roll. As illustrated in FIG. 4, the top end 42 of the stud 40 extends past the outer surface 22 such that material contacting the flange roll 14 is first engaged by the top end 42 of the stud 40. The crushed material forms a bed of material between the studs 40 to also enhance the durability of the outer surface 22.

Referring now to FIG. 5, each end of the flange roll 14 includes a side groove 44 formed at the junction between the cylindrical outer surface 22 and the side face 36. The side groove 44 defines a support shoulder 46 that extends generally along the longitudinal axis of the flange roll 14. The side groove 44 is further defined by an inner wall 48 that is spaced axially inward from the side face 36. The inner wall 48 extends generally radially relative to the longitudinal axis of the flange roll 14.

As illustrated in FIG. 5, the side groove 44 is formed to receive and support a wear assembly 50. The wear assembly 50 is received and positioned within the side groove 44 to increase the durability of the side edges of the flange roll 14. The wear assembly 50 includes an annular edge ring 52 that extends around the entire edge of the roll body 20 between the outer surface 22 and the side face 36. The edge ring 52 is shown in the embodiment of FIG. 3 as formed from a series of edge ring sections 54 that are positioned adjacent to each other to extend around the entire side edge of the flange roll 14. Although the embodiment illustrated in the drawing Figures includes three separate edge ring sections 54, it should be understood that the number of edge ring sections 54 could be increased or decreased while operating within the scope of the present disclosure. The use of multiple edge ring sections 54 facilitates both the manufacture of the edge ring sections 54 as well as the installation of the end ring sections 54 onto the roll body of the flange roll 14.

Referring now to FIGS. 3 and 5, each of the edge ring sections 54 includes an inner surface 56 and an outer surface 58. The inner surface 56 rests upon and is supported by the support shoulder 46 of the side groove 44.

Figure 7:
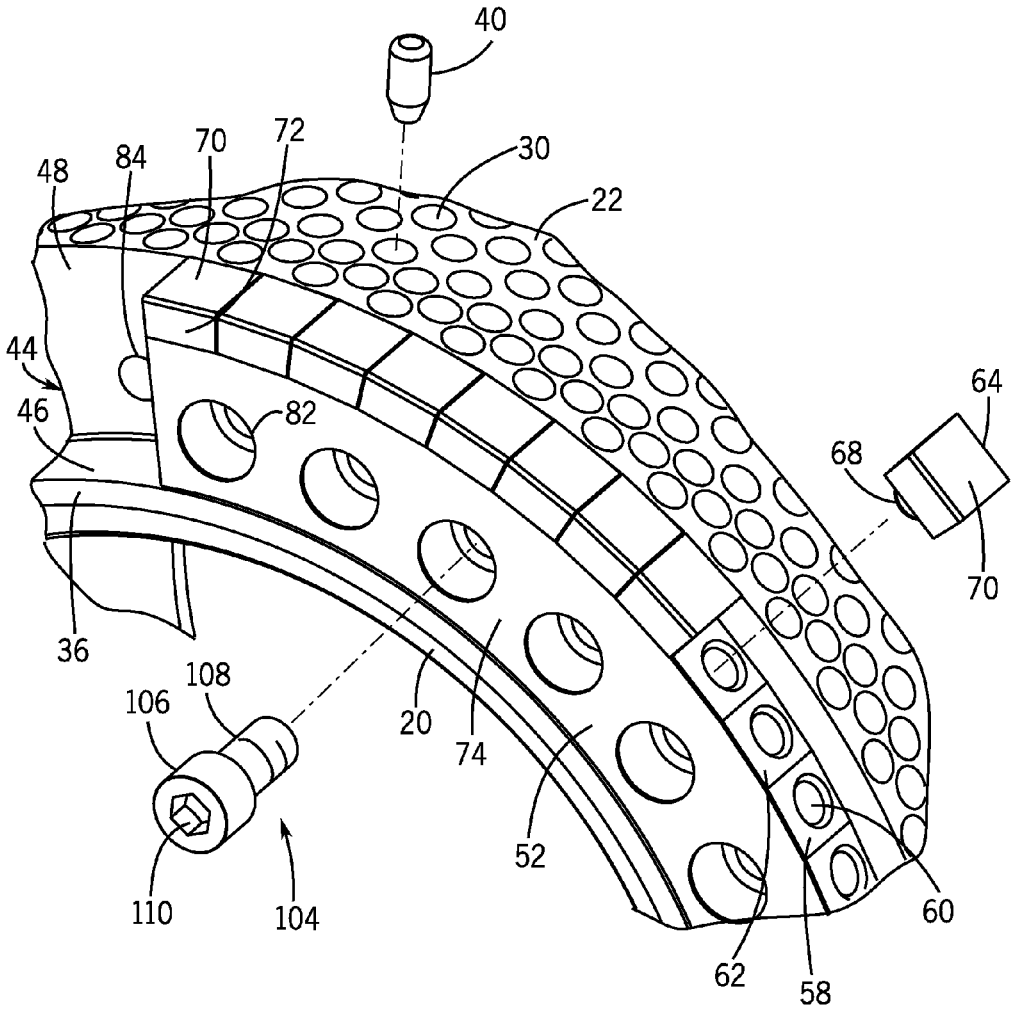
FIG. 7 is a magnified, partial exploded view of the grinding roll.

As can be understood in FIGS. 5 and 7, the edge ring 52 includes a series of spaced receiving cavities 60 that extend into the body of the edge ring 52 from the outer surface 58. As illustrated in FIG. 7, the outer surface 58 of the edge ring 52 includes a series of flat seats 62 onto which the receiving cavities 60 open. The flat seats 62 provide a flat mounting surface for one of a plurality of wear members 64. Although flat seats 62 are illustrated, the seats 62 could be curved and configured to match a corresponding curved surface on the underside of the body portion 66 of each wear member 64.

Figure 9:
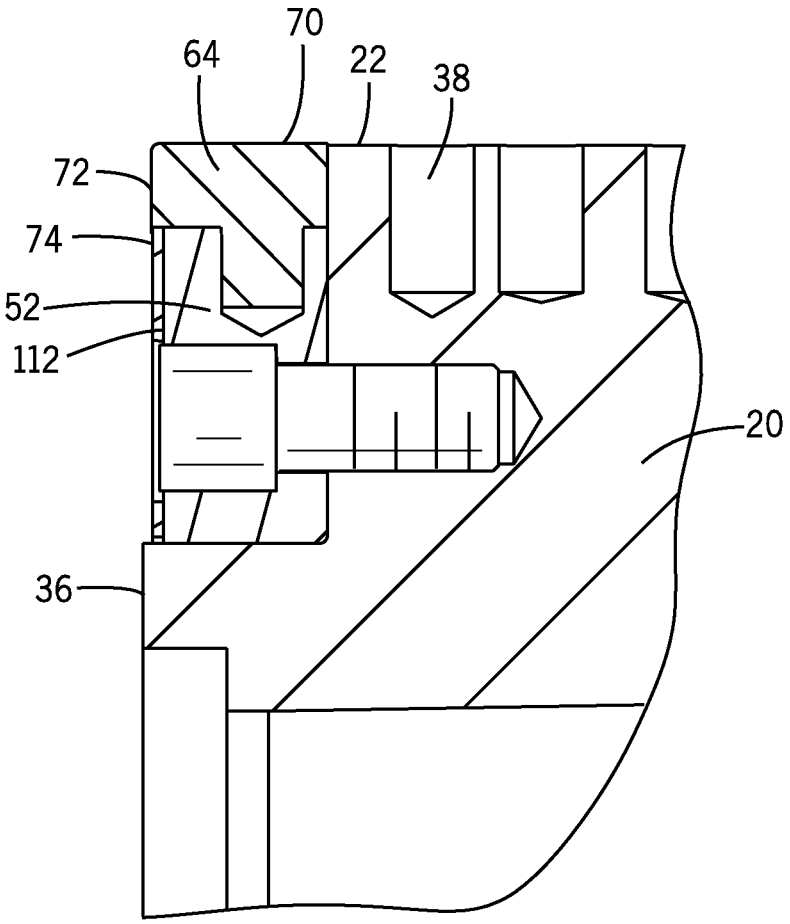
FIG. 9 is a magnified, section view taken along line 9-9 of FIG. 8.

As illustrated in FIG. 5, each of the wear members 64 includes a body portion 66 and a depending attachment portion 68. The depending attachment portion 68 extends into the receiving cavity 60 and is retained therein. The length of the attachment portion 68 should be less than the depth of the receiving cavity 60 such that the wear members 64 rest on the outer surface 58 and resist the crushing force between the rolls. In one embodiment of the disclosure, an adhesive is positioned between the attachment portion 68 and the receiving cavity 60 to secure the wear member 64 to the edge ring 52. In the embodiment shown in FIG. 5, the wear member 64 includes a generally planar outer surface 70 that is generally flush with the outer surface 22 of the roll body 20. As can be seen in the view of FIG. 9, the wear member 64 also includes an axial end face 72. In the embodiment shown in FIG. 9, the axial end face 72 is spaced axially inward from the side face 36 of the roll body 20. In the embodiment illustrated, the spacing between the end face 72 and the side face 36 is approximately 2 mm, although other dimensions are contemplated as being within the scope of the present disclosure.

Referring back to FIG. 5, when the edge ring 52 is received within the side groove 44, the outer face surface 74 of the edge ring 52 and the end face 72 of the wear member 64 are both spaced axially inward from the side face 36 of the roll body 20. Thus, before the flange ring 24 is mounted to the edge ring 52, a first shim 76 is positioned adjacent and in contact with the outer face surface 74 of the edge ring 52. As illustrated in FIG. 3, the first shim 76 includes a series of cut out sections 78 along the radially inward edge 80. When the first shim 76 is positioned adjacent the outer face surface 74 of each edge ring section 54, the cut out sections 78 are generally aligned with one of a series of connector openings 82. The connector openings 82 are generally in alignment with a corresponding number of bores 84 formed in the inner wall 48 of the roll body which defines a portion of the side groove 44.

Referring back to FIG. 5, a second shim 86 is positioned between the flange ring 24 and both the end face 72 of the wear member 64 and the first shim 76. The second shim 86 creates a generally uniform mounting surface that receives an inner surface 88 of the flange ring 24. The use of the pair of removable shims 86 and 76 allows the roll body 20 to be configured as either the grinding roll 12 (FIG. 1) or the flange roll 14 (FIG. 1).

Although the embodiment shown in the figures includes a pair of shims positioned between the flange ring 24 and the roll body 20, it is contemplated that the flange ring 24 could be constructed with a ledge on the inner surface 88 to provide the required support. In either case, the shims or an integral ledge will provide the required structural support for the flange ring 24 on the roll body 20.

As can be seen in FIG. 3, the flange ring sections 28 that define the flange ring 24 each include a series of connector openings 90 formed near the inner edge 92. As described previously, each of the flange ring sections 28 extends from the inner edge 92 to an outer edge 26. The connector openings 90 are spaced in conformance with the spacing of the connector openings 82 formed in the edge ring sections 54 and the bores 84 formed in the roll body. In this manner, a common series of connectors 94 can be used to secure both the flange ring 24 and the edge ring 52 in the side groove 44 formed in the roll body.

Referring back to FIG. 5, in the embodiment illustrated, the connectors 94 each include a head portion 96 and a threaded shaft 98. The threaded shaft 98 is received and retained by a corresponding series of internal threads in one of the bores 84 that extends into the roll body 20 from the inner wall 48 of the side groove 44. Although threaded bolts are shown in the embodiment of the invention, it should be understood that other types of connectors could be utilized while operating within the scope of the present disclosure. In the embodiment shown in FIG. 5, a washer 100 is positioned between the head portion 96 and the outer surface 102 of the flange ring 24.

Referring back to FIG. 2, the head portion 96 of each of the series of connectors protrudes past the outer surface 102 of the flange ring 24 as illustrated. Each of the connectors 94 can be removed individually to either remove the flange ring 24 or install a flange ring on the roll body. In another contemplated embodiment, the connector openings 90 formed in each flange ring section 28 could be replaced by a slot that is open to the inner edge 92. The use of an open slot rather than a circular connector opening would only require the connectors 94 to be loosened and not entirely removed prior to removal of the flange ring section 28. This configuration would be particularly desirable in limited space applications since the connectors 94 would not need to be completely removed to replace the flange ring section 28.

In a similar manner, the connector openings 82 formed in the edge ring sections 54 could be replaced with open slots, which would allow the edge ring sections to be removed without completely removing the connectors 94. Further, the edge ring sections 54 and the flange ring sections 28 could be configured such that every other connector would support both sections while the alternate connectors would only support the edge ring section. In such a configuration, the flange ring sections 28 could be removed and the edge ring sections 54 would remain securely supported on the roll body 20.

The flange roll 14 shown in the drawing figures includes a flange ring 24 on each end of the roll body 20. However, it is contemplated that a flange roll 14 could be configured to include only one flange ring 24 on one end of the roll body 20. Additionally, it is contemplated that two flange rolls 14 could be used where each flange roll 14 would include a flange ring on opposite ends. In such an embodiment, each of the rolls in FIG. 1 would include a flange ring 24.

The flange roll 14 described in FIGS. 2-5 includes many of the same components as utilized to form the grinding roll 12 shown in FIGS. 6-9. Specifically, the grinding roll 12 shown in FIG. 6 can be reconfigured to the flange roll 14 by adding the first shim 76 and the second shim 86 between the flange ring 24, as is illustrated in FIG. 3. If the flange ring 24 and the first and second shims 76, 86 are removed, an alternate connector can then be used to create the grinding roll 12 shown in FIG. 6.

Figure 6:
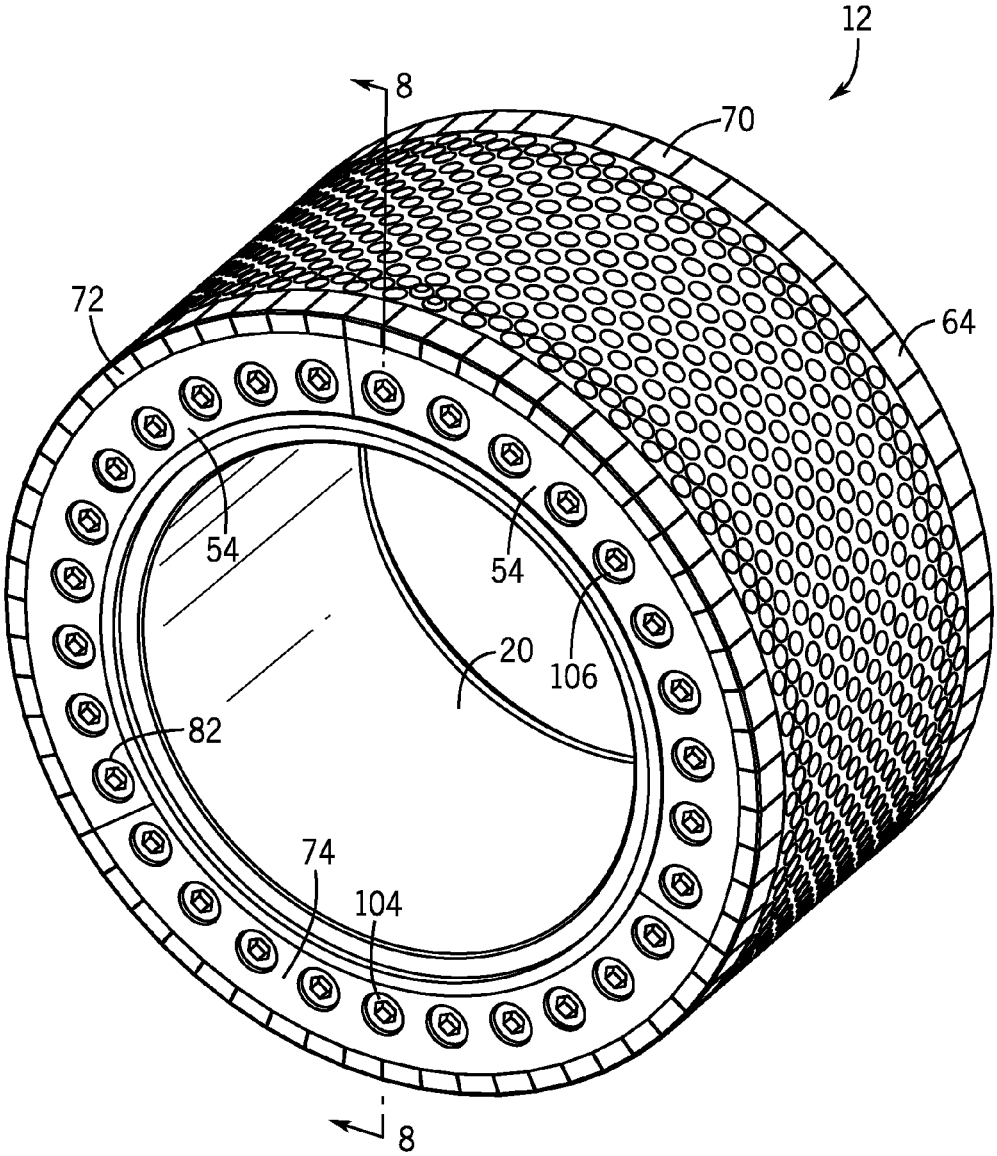
FIG. 6 is an isometric view of the grinding roll shown in FIG. 1.

As illustrated in FIG. 6, the connectors 104 used to secure the edge ring sections 54 to the roll body each include a head portion 106 that is either flush with or slightly recessed from the outer face surface 74 of the edge ring sections 54. Each of the connectors 104 is received within the connector openings 82 of the edge ring section 54 in a similar manner to the receipt of the connectors shown in the flange roll design discussed previously.

As illustrated in FIGS. 6 and 7, the series of wear members 64 are positioned in an end-to-end configuration to define both of the pair of spaced side edges of the grinding roll 12. Alternatively, the wear members could interlock with each other to form the side edges of the grinding roll 12. The outer surfaces 70 of each of the wear members 64 provides enhanced wear durability for the outer surface of the grinding roll near each edge. Likewise, the end faces 72 of each of the wear members 64 are positioned adjacent to each other to enhance the durability of the grinding roll at the transition between the outer surface 22 and the side face 36. As previously described, each of the wear members 64 include an attachment section 68 that is received and retained within one of the receiving cavities 60 formed in the edge ring 52. Although the wear members 64 are each shown being received and retained in one of the receiving cavities 60, the wear members 64 could be configured to include multiple depending sections 64 that would be received in adjacent receiving cavities 60 spaced along the edge ring 52.

The edge ring 52, in turn, is received and retained within the side groove 44 formed at the transition between the outer surface 22 and the side face 36 of the roll body 20. The side groove 44 is defined by the support shoulder 46 and the inner wall 48. The inner wall 48 includes the series of bores 84 that each receive the threaded shaft 108 of the connector 104.

Since the connector 104 is generally recessed from the outer face surface 74, the head portion 106 includes a recessed engagement area 110 that receives the correct type of tool to rotate the connector 104.

Figure 8:
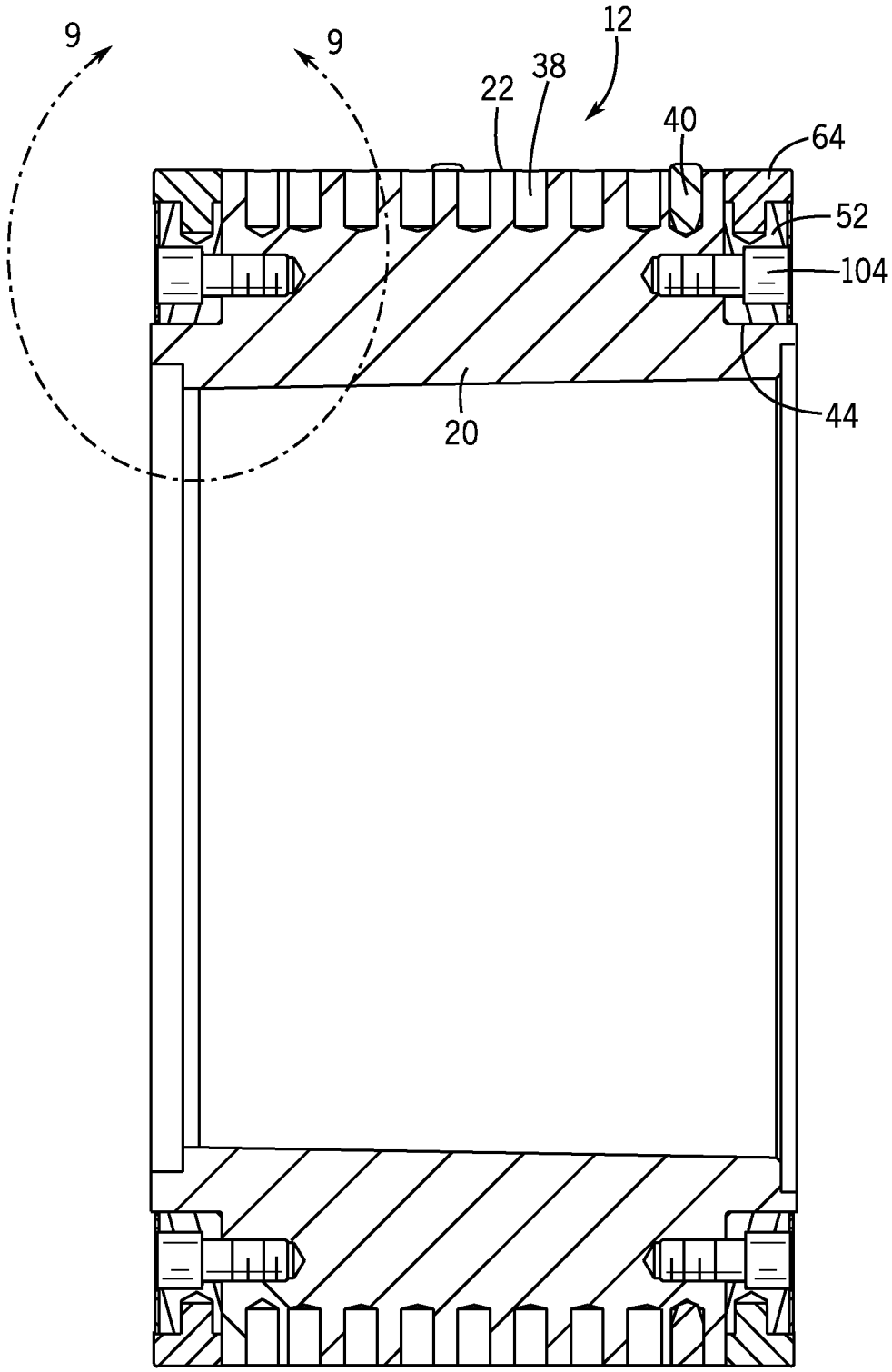
FIG. 8 is a section view taken along line 8-8 of FIG. 6.

FIGS. 8 and 9 further illustrate the position of the edge ring 52 within the side groove 44 of the grinding roll 12. The series of connectors 104 are used to secure the edge ring 52 to the roll body 20 in a similar manner as described with respect to the flange roll. Like the flange roll, the grinding roll 12 includes a series of studs 40 each received in one of a series of receiving bores 38 extending radially inward from the outer surface 22. Each of the edge rings positioned on opposite ends of the grinding roll 12 include and receive the wear members 64.

Referring now to FIG. 9, in the embodiment illustrated, the edge ring 52 includes a wear coating 112. The wear coating 112 can be either applied to the edge ring 52 after formation of the edge ring 42 or during the initial forming process. The wear coating 112 provides enhanced durability for the outer face surface 74. Since the outer face surface 74 is subject to additional wear, the use of the wear coating 112 will enhance the life and durability of the edge ring 52. It is contemplated that the wear coating 112 could be a separate component that is positioned on the edge ring 52 during the assembly process. However, it is contemplated that the wear coating 112 will be preferably permanently attached to the edge ring 52. If the edge ring 52 is constructed from a hard, durable material, the wear coating 112 could be eliminated.

We claim:

1. A grinding roll comprising:

a roll body having a cylindrical outer surface extending axially between a pair of opposite ends;

a side groove formed at each end of the roll body, the side grooves each including a support shoulder recessed from the outer surface of the roll body;

an edge ring received within each side groove, the edge rings each including a plurality of spaced receiving cavities open radially outwardly; and a plurality of wear members received and retained in the plurality of spaced receiving cavities of the edge rings, wherein the wear members are positioned along the edge rings to define edges of the grinding roll.

2. The grinding roll of claim 1 wherein the edge rings are each attached to the roll body by a series of removable connectors that extend axially into the roll body.

3. The grinding roll of claim 1 wherein the edge rings are each formed from a plurality of edge ring sections positioned adjacent to each other along the side grooves.

4. The minding roll of claim 1 wherein the plurality of receiving cavities are open radially relative to the roll body.

5. The grinding roll of claim 4 wherein the wear members each include a body portion and a depending attachment portion, wherein the attachment portion is secured within one of the receiving cavities.

6. The grinding roll of claim 1 further comprising a flange ring attached to each of the edge rings, the flange rings each having an outer edge that extends radially past the outer surface of the roll body.

7. The grinding roll of claim 6 wherein the flange rings are each formed from a plurality of flange ring sections positioned adjacent to each other.

8. The grinding roll of claim 6 wherein the flange rings and the edge rings are attached to the roll body by a common series of connectors.

9. The grinding roll of claim 8 wherein each of the connectors pass through both the flange rings and the edge rings.

10. The grinding roll of claim 9 further comprising an annular shim positioned between the edge rings and the flange rings to provide spacing between the flange rings and the edge rings.

11. The grinding roll of claim 1 wherein the edge rings each include a hardened outer surface.

12. A grinding roll comprising:

a roll body having a cylindrical outer surface extending axially between a pair of opposite ends;

a side groove formed at each end of the roll body, the side grooves each including a support shoulder recessed from the outer surface of the roll body;

an edge ring received within each side groove, the edge rings each including a plurality of spaced receiving cavities open radially outwardly;

a plurality of wear members each received and retained in the plurality of spaced receiving cavities of the edge rings, wherein the wear members are positioned along the edge rings to define edges of the grinding roll; and a flange ring attached to each of the edge rings, the flange rings each having an outer edge that extends radially past the outer surface of the roll body.

13. The grinding roll of claim 12 wherein the flange rings are each formed from a plurality of flange ring sections positioned adjacent to each other.

14. The grinding roll of claim 12 wherein the flange rings and the edge rings are attached to the roll body by a series of common connectors.

15. The grinding roll of claim 14 wherein each of the connectors pass through both the flange rings and the edge rings.

16. The grinding roll of claim 15 further comprising a shim positioned between the edge rings and the flange rings.

17. A grinding assembly for the comminution of material comprising:

a grinding roll and a flange roll positioned adjacent to each other to define an infeed nip therebetween, wherein both the grinding roll and the flange roll comprise:

a roll body having a cylindrical outer surface extending axially between a pair of opposite ends;

a side groove formed at each end of the roll body, the side grooves each including a support shoulder recessed from the outer surface of the roll body;

an edge ring received within each side groove, the edge rings each including a plurality of spaced receiving cavities open radially outwardly; and a plurality of wear members received and retained in the plurality of spaced receiving cavities of the edge rings, wherein the wear members are positioned along the edge rings to define edges of the grinding roll;

wherein the flange roll further comprises a flange ring attached to each of the edge rings, the flange rings each having an outer edge that extends radially past the outer surface of the roll body, wherein the flange rings are each located axially outward from the edge rings of the grinding roll.

18. The grinding roll of claim 17 wherein the edge rings are each formed from a plurality of edge ring sections positioned adjacent to each other along the side groove.

19. The grinding assembly of claim 17 wherein the flange rings are each formed from a plurality of flange ring sections positioned adjacent to each other.

20. The grinding assembly of claim 17 wherein the flange rings and the edge rings are attached to the roll body by a series of common connectors.

* * * * *